US007922510B2

(12) United States Patent
Klinger et al.

(10) Patent No.: US 7,922,510 B2
(45) Date of Patent: Apr. 12, 2011

(54) ELECTRONIC MODULE HAVING A PRESTRESSED FLAT PLUG CONNECTION AND METHOD FOR MOUNTING SUCH AN ELECTRONIC MODULE

(75) Inventors: Herbert Klinger, Nuremberg (DE); Martin Petrzik, Stein (DE); Markus Eichner, Nuremberg (DE); Markus Deeg, Eberdingen (DE); Norbert Behrendt, Stein (DE); Marko Kralicek, Friedrichshafen (DE); Thomas Puth, Friedrichschafen (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 0 days.

(21) Appl. No.: 12/547,263

(22) Filed: Aug. 25, 2009

(65) Prior Publication Data

US 2010/0055967 A1 Mar. 4, 2010

Related U.S. Application Data

(63) Continuation of application No. PCT/EP2008/001404, filed on Feb. 22, 2008.

(30) Foreign Application Priority Data

Feb. 26, 2007 (DE) ..... 10 2007 009 644

(51) Int. Cl.
*H01R 13/64* (2006.01)

(52) U.S. Cl. ..... 439/247

(58) Field of Classification Search ..... 439/246–248, 439/252

See application file for complete search history.

(56) References Cited

U.S. PATENT DOCUMENTS

| | | | |
|---|---|---|---|
| 4,815,986 | A | 3/1989 | Dholoo |
| 4,909,748 | A | 3/1990 | Kozono et al. |
| 5,516,303 | A | 5/1996 | Yohn et al. |
| 6,196,856 | B1 | 3/2001 | De Villeroche |
| 2002/0098730 | A1 | 7/2002 | Babala et al. |
| 2006/0105603 | A1 | 5/2006 | Nishio et al. |

FOREIGN PATENT DOCUMENTS

| | | | |
|---|---|---|---|
| DE | 7208075 | | 6/1972 |
| DE | 39 03 839 | A1 | 8/1989 |
| DE | 689 11 661 | T2 | 5/1994 |
| DE | 699 13 252 | T2 | 11/2004 |
| EP | 0 371 835 | B1 | 6/1990 |
| EP | 1 249 895 | A2 | 10/2002 |

OTHER PUBLICATIONS

German Search Report dated Mar. 25, 2009 including English translation (Twelve(12) pages).

International Search Report dated Aug. 7, 2009 including English translation (Five (5) pages).

*Primary Examiner* — Chandrika Prasad

(74) *Attorney, Agent, or Firm* — Crowell & Moring LLP

(57) ABSTRACT

A module, particularly an electronic module of a commercial vehicle, includes at least one plug connection, having a plug element and a mating plug element, by which an electrical connection can be established when plugged together. At least one of the plug elements is mounted floatingly or movably within a clearance. A method for assembling the module plugs together the plug elements, at least one of the plug elements moving within a clearance relative to the mounting thereof.

15 Claims, 6 Drawing Sheets

ELECTRONIC MODULE HAVING A PRESTRESSED FLAT PLUG CONNECTION AND METHOD FOR MOUNTING SUCH AN ELECTRONIC MODULE

CROSS-REFERENCE TO RELATED APPLICATIONS

This application is a continuation of PCT International Application No. PCT/EP2008/001404, filed Feb. 22, 2008, which claims priority under 35 U.S.C. §119 to German Patent Application No. DE 10 2007 009 644.7, filed Feb. 26, 2007, the entire disclosures of which are herein expressly incorporated by reference.

BACKGROUND AND SUMMARY OF THE INVENTION

The invention relates to a module, in particular an electronic module of a commercial or utility vehicle, having at least one plug connection which includes a plug element and a mating plug element, by which an electrical connection can be established in the plugged-together state.

Furthermore, the invention relates to a method for mounting a module, in particular an electronic module of a utility vehicle, having at least one plug connection which includes a plug element and a mating plug element which are plugged together in order to establish an electrical connection.

In particular in utility vehicles, electronic modules are known. Such modules are components of mechatronic modules and are mounted, for example, on housings or other components of mechanical modules such as that of a transmission. It is therefore possible to provide for the entire electronic module to be, for example, attached to an inner side of a housing cover or of an upper housing part by way of a screw connection. The housing cover is, in turn, attached to a lower housing part or other component of the mechanical module.

In order to establish an electrical connection between components of the electronic module and components of the mechanical module, for example sensors and valves, the electronic module includes one or more plug connections. In this context, a plug element of the plug connection is usually secured to the upper housing part and coupled to the electronic module. A corresponding mating plug element for plugging into the plug element is usually attached to the lower housing part and coupled, for example, to sensors or valves of the mechanical module.

The corresponding housing parts of the electronic and mechanical module are assembled or joined together in a conventional way by orienting the upper and lower housing parts, with the plug element and the mating plug element being guided against one another using, for example, locating pins and insertion slopes. The guiding of the plug elements against one another in order to establish the electrical connection is therefore carried out on the basis of the housing parts which cover it, exclusively using the above-mentioned locating pins and insertion slopes and without visual contact with the plug connection, that is to say, it is carried out "blind". However, both the upper housing part and the lower housing part usually have fabrication-related and/or design-related dimensional deviations or high tolerances in all three dimensions or spatial directions, which makes it more difficult to guide the plug elements against one another. There is therefore the risk that contacts of the plug elements may be damaged when the modules are joined together if the contacts of the plug elements are not guided exactly into position.

Furthermore, the upper housing part and the lower housing part have to be sealed by a seal when assembled, while the plug elements have to be guided against one another simultaneously, which additionally makes mounting more difficult.

In this context, it is important in particular to ensure that the plug elements are attached to one another as far as possible in as physically close a fashion as possible, for example due to high vibration stressing of the mechanical module, in order to avoid to a great extent friction between respective plug element contacts. One way of satisfying these requirements is to screw each of the corresponding plug elements to one another from the outside, that is to say to the outside of the housing, or to attach them rigidly one against the other, for example by use of a locking arrangement, in order to make the plug connection correspondingly resistant to vibration. In particular, in the case of the screwing of the plug elements, it is additionally necessary to seal the screw connection which is brought about from the outside. As a result, the expenditure on disassembling the plug connection is also greatly increased. For example, in the case of servicing, the screw connection has to be disconnected, which involves a relatively large number of small screws. Otherwise, the plug connection would be damaged during disassembly. When assembly is carried out again subsequent to the disassembly, the screw connection must be restored, which involves respectively sealing the individual screws again.

A further possibility is to maintain the plug connection by way of forces from plug contact springs of the respective plug elements, for example by use of a corresponding clamping arrangement. However, this results in the disadvantage that in contact zones of the plug contact springs of the respective plug elements micromovements can occur, which can damage the plug contact springs in the contact zone. As a result, in the worst case, the electrical connection can be interrupted. Owing to the above-mentioned problems, in certain cases a procedure has been adopted of not guiding the plug elements one against the other "blind," but rather of already coupling the plug elements to one another before the housing parts or the other components are mounted. For example, in this case, the one plug element is pre-mounted on the upper housing part. In contrast, the other plug element or the mating plug element is coupled directly to the pre-mounted plug element with visual contact. The mating plug element is, in this case, a loose mating plug element, which is coupled to a cable or to flexible lines. The corresponding housing parts are not coupled to one another until after the plug element and the mating plug element have been coupled to one another in order to permit an electrical connection. However, in this case there is the problem that the cables or flex lines which are used for the loose mating plug element can only be arranged within the module in an uncontrolled way due to the joining of the housing parts and can, as a result, possibly be pinched. This can result in damage to the cables or flex lines which are used, as a result of which in the worst case the electrical connection may be disconnected.

The invention is therefore based on the object of developing such modules, and providing methods for mounting such modules, in particular for "blind" mounting of such modules, in a way that an electrical connection is ensured even in the case of fabrication-related and/or design-related inaccuracies in dimensions of the housing parts without causing damage to the at least one plug connection. In particular, in this context, it is also an object of the invention to implement plug connections which are as vibration-resistant as possible.

This object is achieved by a module, in particular an electronic module of a utility vehicle, having at least one plug connection which includes a plug element and a mating plug element, by which an electrical connection can be established in the plugged-together state. At least one of the plug elements is mounted floatingly or movably within a clearance. The object is further achieved by a method for mounting a module, in particular an electronic module of a utility vehicle, having at least one plug connection which includes a plug element and a mating plug element that are plugged together in order to establish an electrical connection. At least one of the plug elements moves within a clearance with respect to its mount when plugging together the plug elements.

Advantageous refinements and developments of the invention are described herein.

The module according to the invention has at least one of the plug elements mounted floatingly or movably within a clearance. For example, the mating plug element is rigidly connected to an electronic element of the electronic module, for example a printed circuit board. The electronic element can also be connected to an upper housing part or a housing upper part. In contrast, the plug element is mounted floatingly or movably within a clearance on a line carrier or a flexible printed circuit board or a leadframe, which is embedded, for example, in a plastic holder. The floatingly mounted plug element is preferably electrically connected in a flexible way (for example by means of flex, leadframes, cables, etc.). The line carrier can, in turn, be attached to a lower housing part or some other component. This permits the floatingly mounted plug element to compensate for fabrication-related and/or design-related tolerances by virtue of the floating mount. Furthermore, in order to additionally compensate for high tolerances, the plug elements can preferably be equipped with plug contact elements, for example thin metal strips, which have bends (round or square-edged) or tapered portions. As a result, blind mounting of one or more plugs can be performed when the module is closed, while the plugging forces during the mounting are advantageously taken up by the floating mount of the plug element. The floating mount of the plug element is preferably configured such that it can compensate for tolerances in all three spatial directions. Particularly advantageous compensation of tolerances is obtained if both the plug element and the mating plug element are floatingly mounted.

The module according to the invention can advantageously be developed by mounting one or both of the plug elements floatingly or movably within the clearance in a plugging direction. With respect to the plug contact elements, the bends which are provided on them can be embodied in such a way that, in order to additionally compensate high tolerances, the plug contact elements, which are bent at least in certain sections, compensate high tolerances both in the plugging direction of the plug elements and in a direction which is perpendicular thereto depending on the embodiment of the bend, in addition to the compensation by the floating mount. The tapered portions of the plug contact elements can be provided such that, in addition to the compensation of the tolerances by the floating mount in the plugging direction, compensation is made possible perpendicular to the plugging direction by virtue of the tapered portions.

In addition, the module according to the invention can be embodied such that the other plug element is non-movably mounted. This plug element is therefore provided, for example, to be inserted or plugged in through the upper housing part into the floatingly mounted plug element, which is attached to the non-moved lower housing part.

Furthermore, the module according to the invention can be implemented such that one of the plug elements can be prestressed against the other of the plug elements by use of a spring element. After the plug elements have been guided one against the other by assembly, they are therefore pressed together with the spring elements into the end position and secured. The contact friction owing to vibration stresses can be avoided by pressing the one plug element through the spring element in the direction of the other plug element. As a result, the screwing of the plug connection by use of several small screws which are to be sealed and which can cause problems in the case of servicing (tearing off of the plug pins or plug contact pin elements and the seals being forgotten or damaged) is eliminated. In this case, the situation in which, in the case of servicing, cables or flex lines of the loose plug element can be torn off or pinched is also avoided. The housing parts can therefore be assembled in a single fabrication step without the plug elements of the plug connections having to be additionally coupled to one another manually, for example by way of a locking arrangement.

Furthermore, the module according to the invention can be implemented such that the plug elements each include one or more guide devices by which the plug elements can be guided one against the other in order to establish the electrical connection. As a result, "blind" mounting of the plug elements is made possible without the plug connection having to be in the field of vision or mounting range of the fitter, in particular when the upper part and lower part of the corresponding modules are being assembled or joined together.

In this context, the module according to the invention can also be developed such that the guide devices of the plug elements are each formed by sliding faces and/or form fits, by which the plug elements slide one on the other in order to establish the electrical connection. The plug elements or plug housings, which are assigned to the plug elements, preferably have locating pins and/or installation/insertion slopes such as sliding faces or correspondingly embodied chamfers in order to be able to bring about the electrical connection by means of the plug connection as easily as possible.

The module according to the invention is preferably embodied in such a way that the one of the plug elements is mounted on a line carrier, which is secured to a housing lower part.

Furthermore, the module according to the invention is advantageously implemented in such a way that the other of the plug elements is mounted on a printed circuit board, which is secured to a housing upper part.

Furthermore, the module according to the invention can be embodied in such a way that the plug connection is a flat plug connection or a round plug connection. This round plug connection or flat plug connection is particularly characterized by its robustness and, in conjunction with the mounting of the electronic and mechanical module, it is therefore particularly advantageous, in particular owing to the blind mounting by way of the guide device. The movably mounted plug element is preferably electrically connected to a flexible line carrier, for example to a flex printed circuit board, a leadframe, a ribbon cable, cables, etc.

The method according to the invention for mounting a module, in particular an electronic module, is based upon plugging together the plug elements during which at least one of the plug elements moves within a clearance with respect to its mount. The method according to the invention can preferably also be implemented with a plurality of plug connections, which each include plug elements and mating plug elements and are arranged at different positions within the module. In this case also, all that is necessary is to carry out a corresponding assembling or mounting process. For example, the plug elements and mating plug elements can each be provided on multi-pin connectors. Furthermore, by use of the method according to the invention, the properties and advantages which are explained in conjunction with the module according to the invention are provided in the same or a similar way, for which reason reference is made to the corresponding statements relating to the module according to the invention in order to avoid repetition.

The same applies appropriately to the following preferred embodiments of the method according to the invention, in which, in order to avoid repetitions, reference is also made in this regard to the corresponding statements relating to the module according to the invention.

The method according to the invention can advantageously be developed in such a way that it includes the plugging together of the plug elements during which one or both of the plug elements move in a plugging direction within the clearance with respect to its mount.

Furthermore, the method according to the invention can be embodied in such a way that it includes the plugging together of the plug elements during which the other of the plug elements does not move with respect to its mount.

In addition, the method according to the invention can be implemented in such a way that it includes the plugging together of the plug elements during which one of the plug elements is prestressed against the other plug element. The prestressing of the one plug element against the other is preferably carried out by a spring element, which prestresses the movably mounted plug element in its end position against the non-movable plug element. However, in this context, it is possible to use any elastic element, which would be known to a person skilled in the art and which would be suitable for prestressing the plug element against the non-movably mounted plug element.

Furthermore, the method according to the invention can be embodied in such a way that it includes the plugging together of the plug elements during which the plug elements are each guided one against the other by one or more guide devices.

In this context, the method according to the invention can be developed in such a way that it includes the plugging together of the plug elements during which the plug elements slide one against the other by way of the guide devices, which are each formed by sliding faces and/or form fits, in order to establish the electrical connection.

Furthermore, the method according to the invention can be implemented in such a way that it includes mounting of one of the plug elements on a line carrier, which is secured to a housing lower part, before the plugging together of the plug elements is performed.

The method according to the invention can preferably be embodied in such a way that it includes mounting of the other plug element on a printed circuit board, which is secured to a housing upper part, before the plugging together of the plug elements is performed.

In one preferred embodiment, the method according to the invention is implemented in such a way that it includes plugging together the plug elements in order to establish a plug connection, which is formed by a flat plug connection or round plug connection.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
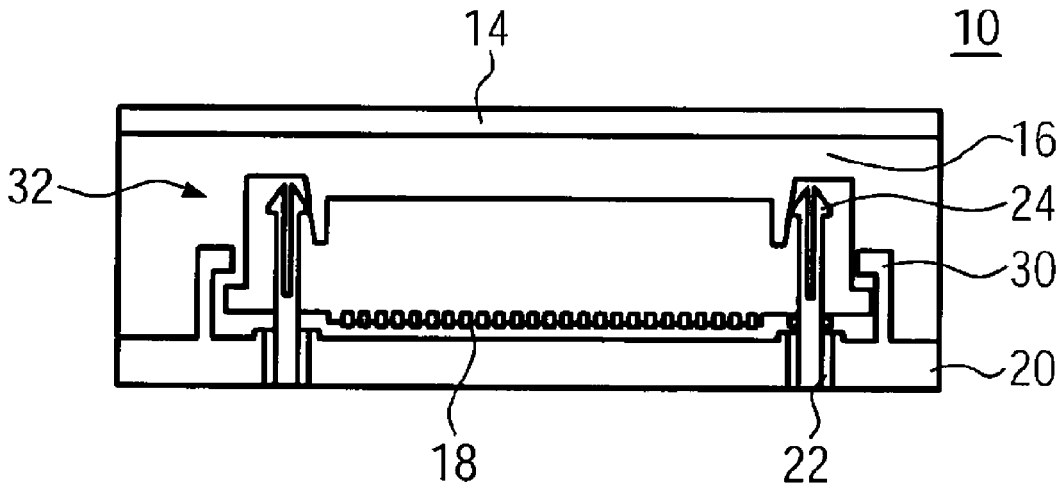
FIG. 1 is a schematic illustration of a module according to the invention according to a first exemplary embodiment, in which the module is suitable for carrying out the method according to the invention.

FIG. 1 illustrates a module 10 according to a first exemplary embodiment, in which the module 10 is suitable for carrying out the method according to the invention for mounting the module 10. In the illustrated case, the module 10 includes one or more plug connections 32, only one being illustrated for the sake of simplicity. The plug connection 32 has a plug element 18 and a mating plug element 16. The plug element 18 includes plug cavity contact elements, which are not illustrated in more detail, into which plug pin contact elements of the mating plug element 16 can be correspondingly plugged in a plugging direction (z direction) in order to establish an electrical connection. The plug element 18 is floatingly mounted, i.e. movably mounted, within a predefined clearance in the plugging direction, by way of an attachment device 24 on a line carrier 20 or some other part of the module 10. The plug element 18 is additionally, preferably, floatingly mounted in directions perpendicular to the plugging direction (x-y directions). Furthermore, the plug element 18 is connected to lines running on or in the line carrier 20, via the corresponding plug contact elements.

Figure 2:
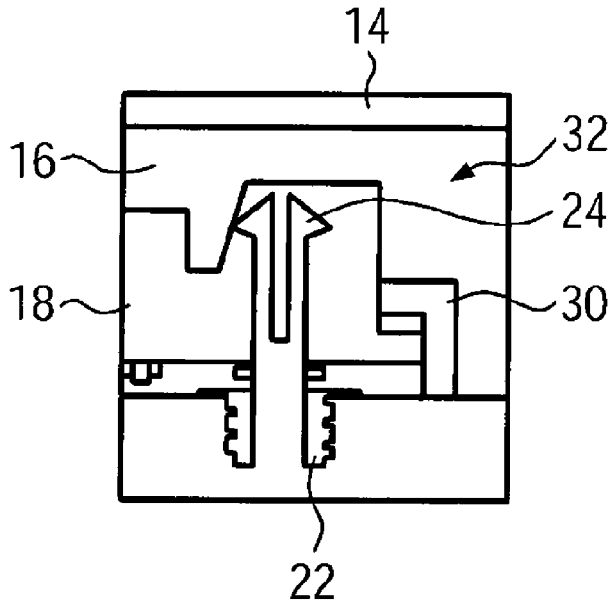
FIG. 2 is an enlarged illustration of an attachment device of a plug element of the module according to FIG. 1.

The attachment device 24 for pre-securing the plug element 18 is embodied in the form of a conventional latching-in or clipping connection in this exemplary embodiment, as is apparent, in particular, in FIG. 2. A clearance perpendicular to the plugging direction, similar to a clearance fit, preferably exists between the latching-in connection and the plug element 18, with the result that the plug element 18 can also be moved perpendicularly with respect to the plugging direction within the clearance. It is therefore possible to plug the plug element 18 on in the direction of the line carrier 20 and to latch it by way of the attachment device 24 in order to attach it, as a result of which the plug element 18 can be moved within the clearance in accordance with the length of the attachment device which is embodied in the manner of a tappet. In particular, the clearance is limited by a stop of the attachment device 24. On the other hand, the plug element 18 can only be removed or unlatched by pressing together the attachment device 24, as is apparent, in particular, from the enlarged illustration of the attachment device 24 in FIG. 2.

Figure 3:
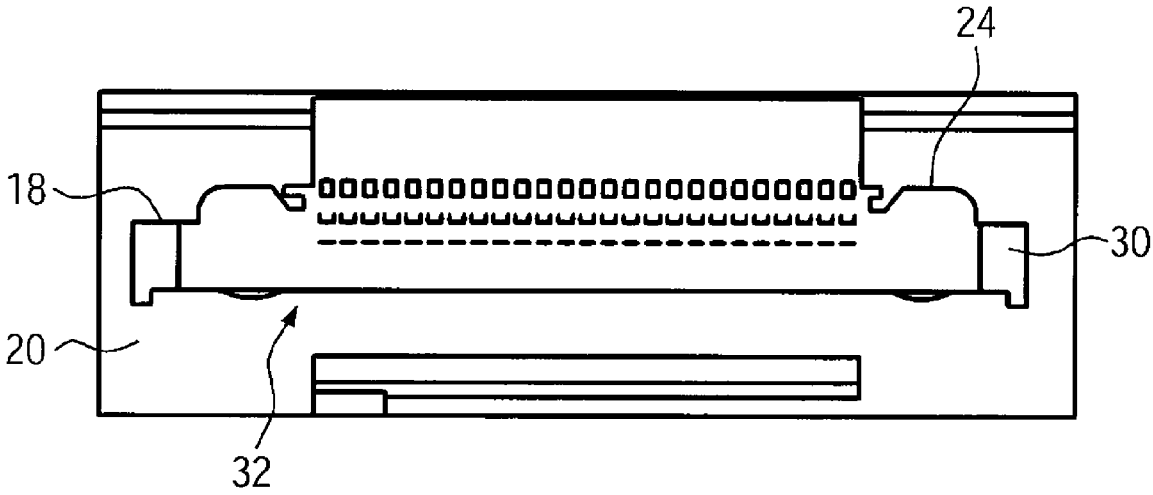
FIG. 3 is an isometric view of the module according to FIG. 1.
Figure 4:
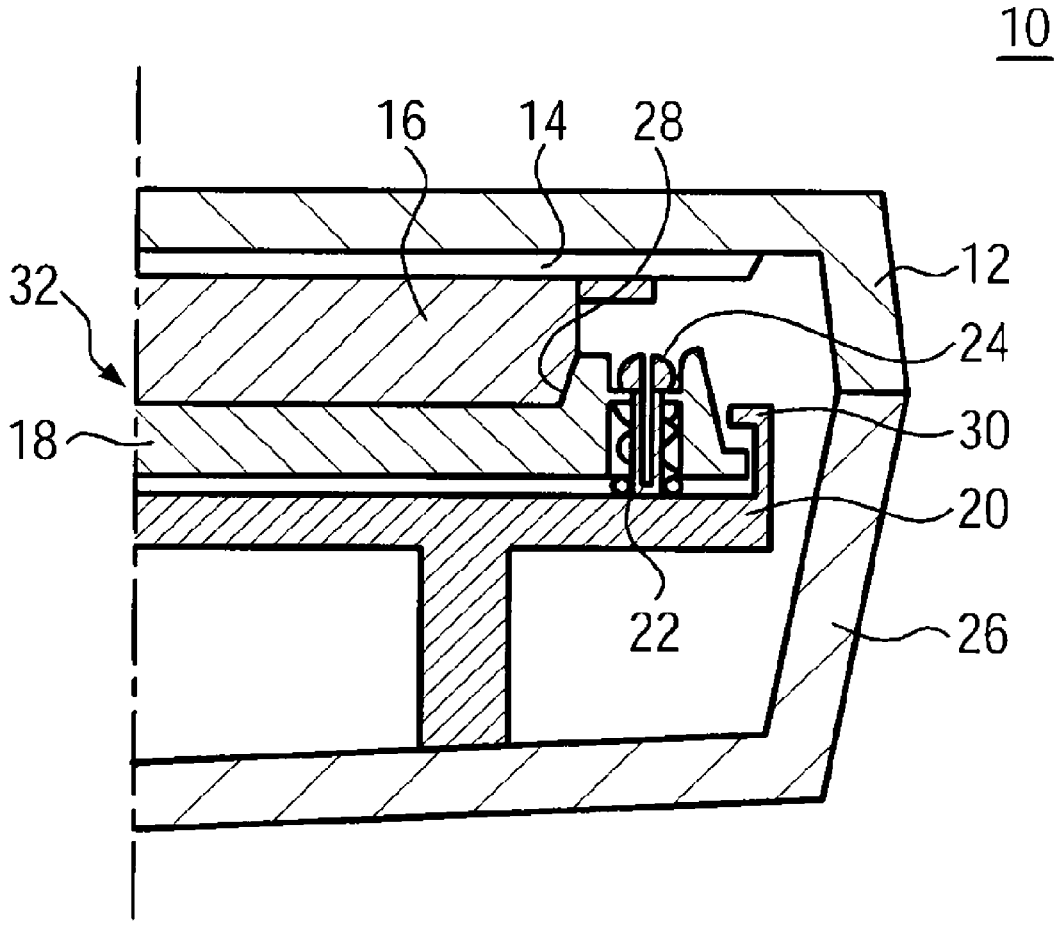
FIG. 4 is a sectional illustration of the module according to FIG. 1.

Furthermore, the plug element 18 is prestressed in the direction of the mating plug element 16 by way of a spring element 22, which is arranged around the attachment device 24 between the line carrier 20 and the plug element 18. In this context, FIG. 3 provides an isometric view of the module 10 in FIG. 1 in order to provide a better overview. Returning to FIG. 1, the line carrier 20 is coupled to a lower housing part or a housing lower part 26 (see FIG. 4) or some other component. The mating plug element 16 is coupled rigidly, and therefore non-movably, to a printed circuit board 14. The printed circuit board 14 is in turn, coupled to an upper housing part or a housing upper part 12 or some other component (see FIG. 4). Furthermore, in each case, the plug contact elements of the mating plug element 16 are electrically coupled to lines (not illustrated) of the printed circuit board 14. As is apparent in particular from FIG. 4, the plug element 18 and the mating plug element 16 each have insertion slopes in the form of sliding faces or chamfers, which facilitates assembly, as is explained below. In addition, a demounting support element 30 is provided on the line carrier 20, which demounting support element 30 can be at least partially placed in contact with edge sections of the plug element 18 when it is demounted, in order to permit damage-free demounting in the case of servicing. Furthermore, the upper and lower housing parts 12, 26 are coupled to one another. A seal (not illustrated), which prevents moisture penetrating into the interior of the housing, is provided between the housing parts 12, 26.

The method for mounting the module 10 is carried out as follows. Firstly, the printed circuit board 14 with the mating plug element 16 provided thereon is attached to the upper housing part 12. Likewise, the plug element 18 is attached to the line carrier 20 via the attachment device 24, the plug element 18 being floatingly mounted. The line carrier 20 is secured to the lower housing part 26. Therefore, both the plug element 18 is pre-secured or pre-mounted on the lower housing part 26, and the mating plug element 16 is pre-secured or pre-mounted on the upper housing part 12. The upper housing part 12 is subsequently guided toward the lower housing part 26 or assembled with the lower housing part 26. At the same time, the mating plug element 16 is guided, given corresponding orientation of the housing parts 12, 26, by the insertion slopes 28 of the mating plug element 16, and in the direction of the plug element 18 by the insertion slopes 28 of the plug element 18. As soon as the mating plug 16 has established the electrical connection to the plug element 18 by way of the respective plug contact elements, and both plug elements 16, 18 have been pushed into one another to the maximum extent, the floatingly mounted plug element 18 moves along with the mating plug 16 counter to the prestress of the spring element 22. Likewise, when the housing parts 12, 26 are brought together, the floatingly mounted plug element 18 can move perpendicularly with respect to the plugging direction in order also to be able to compensate possible inaccuracies in the dimensions of the housing parts 12, 26 perpendicularly with respect to the plugging direction. As a result, on the one hand, fabrication-related and design-related tolerances can be compensated. On the other hand, the electrical connection between the plug elements 16, 18 is ensured by way of prestressing of the spring element 22, since the latter continuously presses the plug elements 16, 18 together, and for this purpose exerts a larger force than the plug pins opposing the force. Likewise, the housing parts 12 and 26 are coupled to one another, during which process a circumferential seal can be interposed between the housing parts.

Figure 5:
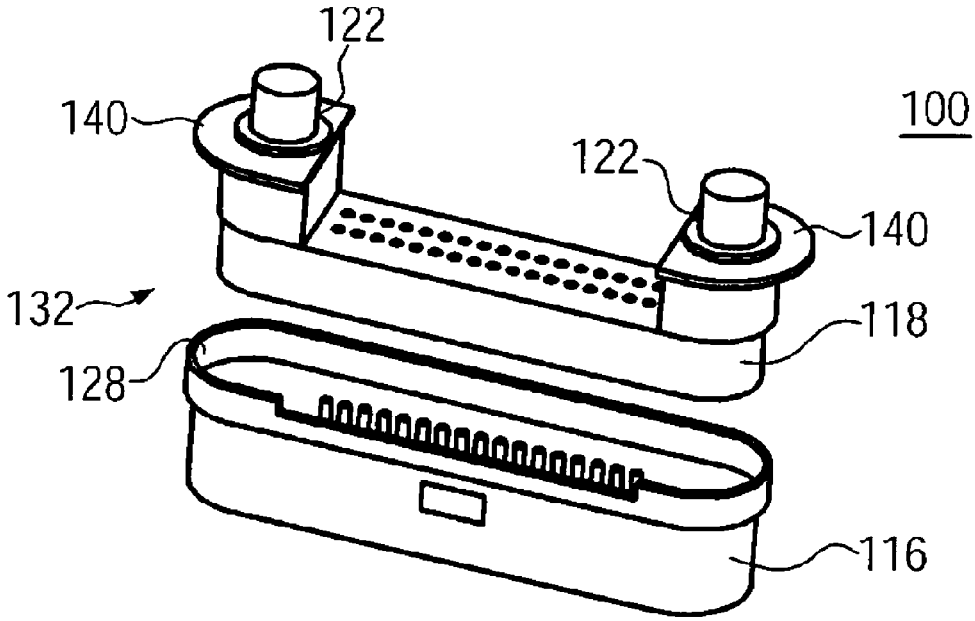
FIG. 5 is an isometric illustration of a plug element of a module according to a second exemplary embodiment, in which the module is suitable for carrying out the method according to the invention.

FIG. 5 is an isometric illustration of a plug connection 132 of a module 100 according to a second exemplary embodiment. The module 100 here is suitable for carrying out the method according to the invention. In order to avoid repetition, the description of the second exemplary embodiment only contains details on the differences from the first exemplary embodiment. In this context, components which relate to the second exemplary embodiment and which correspond to the components of the first exemplary embodiment or are similar thereto are denoted by similar reference numbers. As is also the case in the first exemplary embodiment, the plug connection 132 includes a plug element 118 and a mating plug element 116. In this case, the spring element 122 is accommodated in each case at an end section of the plug element 118 in a cylindrical cavity, as is apparent, in particular, from FIG. 6. As is apparent in FIG. 5, a cutout with electrical contacts is provided between the end sections of the plug element 118. Furthermore, the end sections of the plug element 118 are each provided with a collar 140 which extends radially from the end section. These collars 140 serve to bring about the floating mount of the plug element 118, as is explained below.

In this exemplary embodiment, the mating plug element 116 is embodied in the form of an elongated hole and in the manner of a hollow body in order to accommodate the plug element 118, and the mating plug element 116 has insertion slopes 128 at its edge section, which insertion slopes 128 are embodied in the form of a collecting funnel. The insertion slopes are preferably inclined at an angle of 30° with respect to the plugging direction, as is apparent in particular from FIG. 6.

Figure 6:
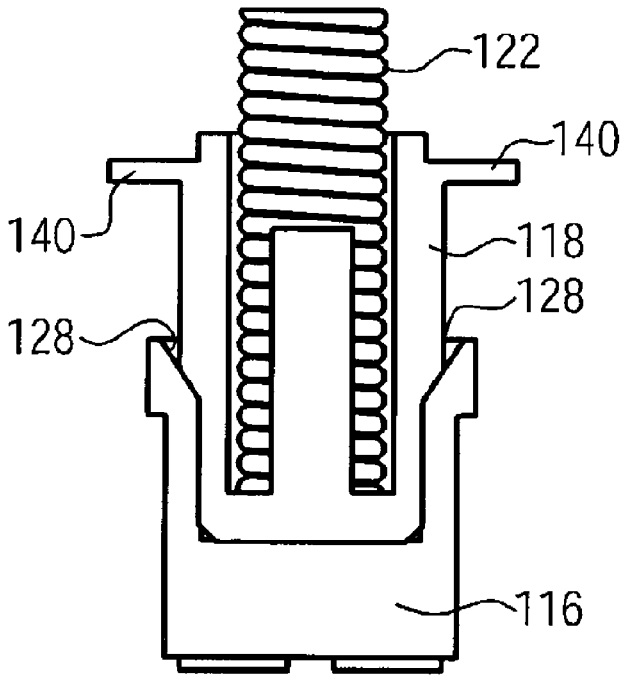
FIG. 6 is a cross-sectional illustration of the plug element in FIG. 5.

FIG. 6 is a cross-sectional illustration of the plug element 118 from FIG. 5, and in this illustration the plug element 118 and the mating plug element 116 are coupled to one another in order to establish the electrical connection. As is also apparent from FIG. 6, the spring element 122 is accommodated in the cylindrical cavity of the end section of the plug element 118 and, at the same time, it surrounds a projection or tappet or dome extending along a longitudinal axis of the cylindrical cavity, with the result that the spring element is attached to the plug element 118 by way of the projection, and is therefore captive.

Figure 7:
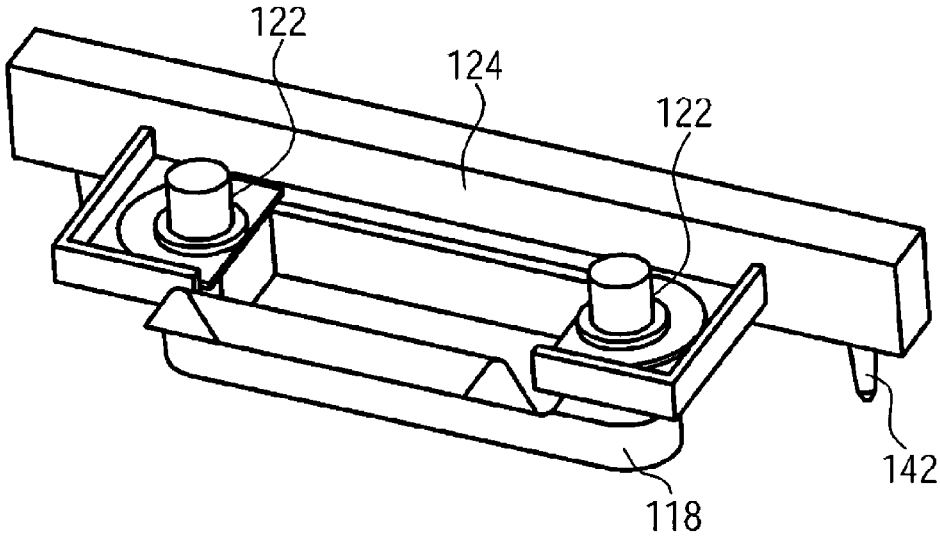
FIG. 7 is an attachment device of the plug element in FIG. 5.

FIG. 7 shows an attachment device 124 for attaching the plug element 118 from FIG. 5. As is apparent therefrom, the plug element 118 is floatingly mounted by way of an attachment device 124, which is embodied as a plastic frame. As is also the case in the first exemplary embodiment, the plug element 118 is movably mounted within a clearance in the plugging direction (or longitudinal axis of the cylinder space or longitudinal axis of the spring element) as is explained in detail below in relation to FIG. 10. The attachment device 124, which is embodied as a plastic frame, includes, for the purpose of securing it to a component of the module 100, securing tappets 142, which are preferably secured to a lower housing part or a module lower part.

Figure 8:
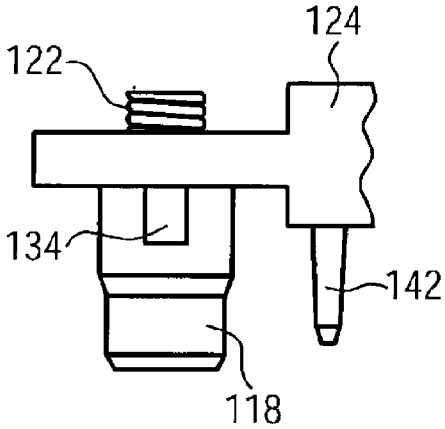
FIG. 8 is a side view of the attachment device in FIG. 7.

FIG. 8 is a side view of the attachment device from FIG. 7. It is apparent therefrom that the attachment device 124 is equipped with additional support elements or clips 134 on an underside of the attachment device in order to orientate the plug element 118 precisely. These clips serve, in particular, to guide the plug element 118 in the plugging direction, but they are of flexible or elastic design.

Figure 9:
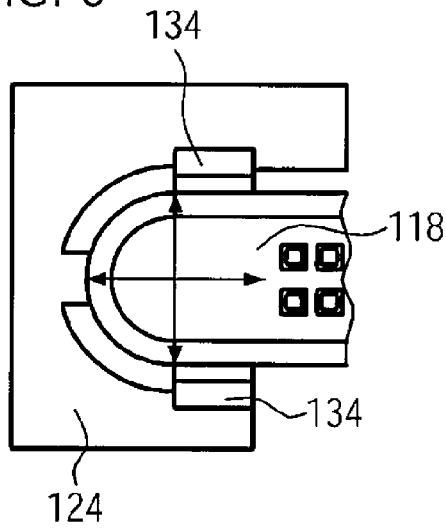
FIG. 9 is a bottom view of the attachment device in FIG. 7 with a plug element mounted therein.

FIG. 9 is a bottom view of the attachment device 134 in FIG. 7 with a plug element 118 mounted therein. As is apparent from the arrows illustrated in FIG. 9, the attachment device 124 also supports the plug element 118 in a floating fashion in directions perpendicular to the plugging direction (x-y direction) within a clearance. This clearance is predefined here by the configuration of the collar 140 and of the attachment device 124, which is embodied as a plastic frame.

Figure 10:
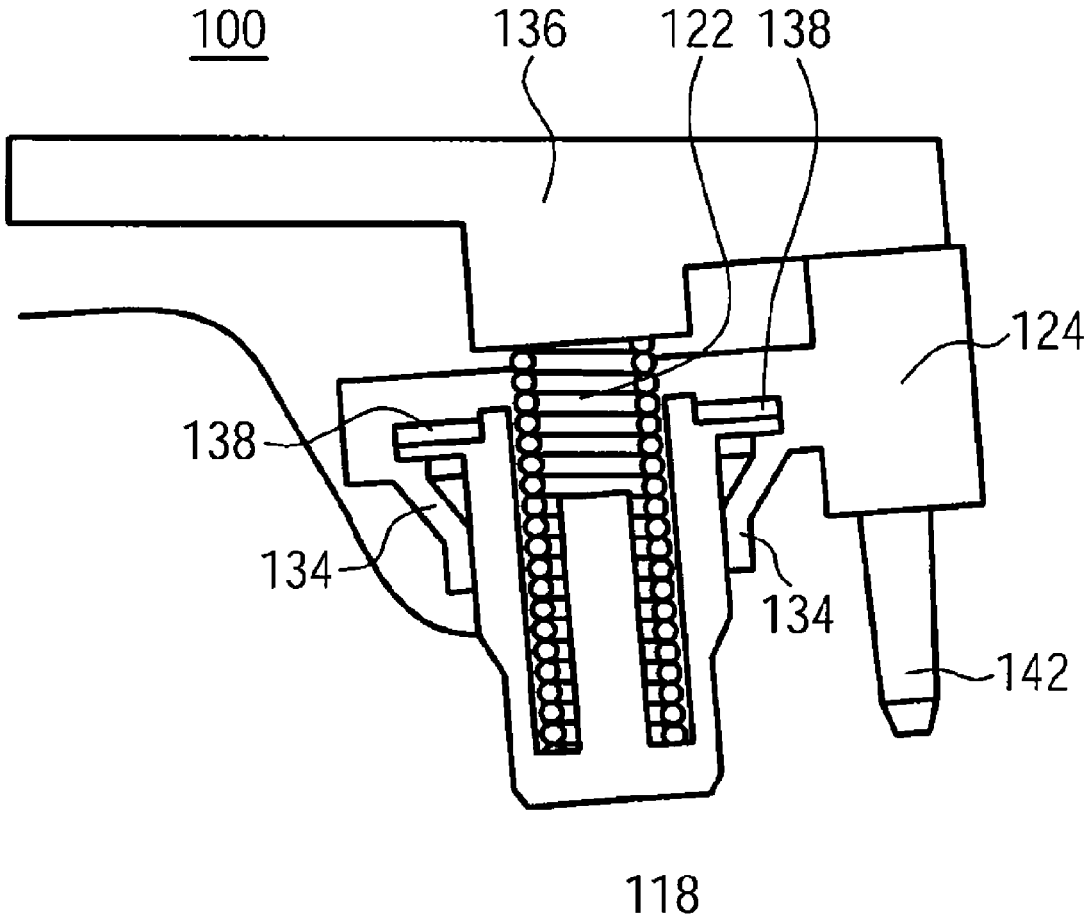
FIG. 10 is a cross-sectional view of the module according to the second exemplary embodiment with a prestressed, movably mounted plug element.

FIG. 10 is a cross-sectional view of the module 100 according to the second exemplary embodiment with the prestressed and movably or floatingly mounted plug element 118. The attachment device 124 is held or supported in this case by a component (not illustrated) of the module 100, in particular by way of the securing tappets 142 of the module 100. Likewise, the plug element 118 is coupled to the mating plug element 116 in order to establish the electrical connection, but the mating plug element 116 is not illustrated in FIG. 10. In contrast to the first exemplary embodiment, a prestress is applied to the plug element 118 by virtue of the fact that a module cover or a housing cover 136 (or some other component of the module 100) acts directly on the spring element 122 via a projection formed on the module cover 136. At the same time, the module cover 136 is supported with an end section on a section of the attachment device 124. The position of the plug element 118, which is movably or floatingly mounted within the clearance 138, is therefore set in accordance with the spring force of the spring element 138 and as a function of the position of the mating plug element 116 in relation to the plug element 118.

The method for mounting the module according to the second exemplary embodiment of the invention operates similarly to that in the description of the first exemplary embodiment, for which reason in order to avoid repetition the description of the method refers to the mounting of the module in accordance with the first exemplary embodiment. In particular, the attachment device 124 is pre-secured, by way of its securing tappets 142, to one of the housing parts or to some other component of the module 100. In this context, the plug element 118 is accommodated in the mating plug element 116 by the insertion slopes or the collecting funnel 128 of the mating plug element 116. In this context, the floating mounting of the plug element 118 brings about tolerance compensation in directions perpendicular to the plugging direction when the two plug elements 116, 118 are plugged together. As soon as the plug element 118 and the mating plug element 116 have been brought together or plugged one into the other to the maximum extent, tolerance compensation takes place in the plugging direction by way of the floating mount of the plug element 118. The plug element 118 is prestressed against the mating plug element 116 by the spring element 122 in the end position of the plug element 118 in the mating plug element 116.

Table of Reference Numbers

| | |
|---|---|
| 10 | Electronic module |
| 12 | Upper housing part |
| 14 | Printed circuit board |
| 16 | Mating plug element |
| 18 | Plug element |
| 20 | Line carrier |
| 22 | Spring element |
| 24 | Attachment device |
| 26 | Lower housing part |
| 28 | Insertion slopes |
| 30 | Demounting support element |
| 32 | Plug connection |
| 100 | Electronic module |
| 116 | Mating plug element |
| 118 | Plug element |
| 122 | Spring element |
| 124 | Attachment device |
| 128 | Insertion slopes |
| 132 | Plug connection |
| 134 | Clips |
| 136 | Module cover |
| 138 | Clearance |
| 140 | Collar |
| 142 | Securing tappet |

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An electronic module of a commercial vehicle, comprising:

at least one plug connection comprising a plug element and a mating plug element, by which an electrical connection is made in a plugged-together state of the plug element and the mating plug element; and wherein at least one of the plug element and mating plug element comprises a floating or moving mount of said at least one of the plug element and the mating plug element within a clearance; and wherein the plug connection is a flat plug connection;

wherein spring elements are arranged at two farthest end sections of the mounted flat plug connection in a plane perpendicular to a plugging direction; and wherein the spring elements prestress the plug element in the plugging direction against the mating plug element.

2. The electronic module according to claim 1, wherein said floating or moving mount floats or moves within the clearance in the plugging direction of the plug element and the mating plug element.

3. The electronic module according to claim 1, wherein the other plug element is non-movably mounted.

4. The electronic module according to claim 2, wherein the other plug element is non-movably mounted.

5. The electronic module according to claim 1, wherein each of the plug element and the mating plug element comprise one or more guide devices by which the plug element and the mating plug element are guidable against one another in order to establish the electrical connection.

6. The electronic module according to claim 5, wherein said one or more guide devices each comprise a slide face surface cooperating with one another such that the plug element and the mating plug element slide against one another in order to establish the electrical connection.

7. The electronic module according to claim 1, further comprising:

a line carrier on which is mounted one of the plug element and the mating plug element; and a housing part in which the line carrier is secured.

8. The electronic module according to claim 1, further comprising:

a printed circuit board on which one of the plug element and the mating plug element is mounted; and a housing part in which the printed circuit board is secured.

9. The electronic module according to claim 7, further comprising:

a printed circuit board on which the other plug element is mounted; and a second housing part to which the printed circuit board is secured.

10. The electronic module according to claim 9, wherein the housing part is a bottom housing part and the second housing part is a top housing part.

11. A method for mounting an electronic module of a commercial vehicle, the module having at least one flat plug connection including a plug element and a mating plug element, the method comprising the acts of:

arranging spring elements at the two farthest end sections of the plug element in a plane perpendicular to a plugging direction, wherein the spring elements prestress the plug element in the plugging direction against the mating plug element;

plugging together the plug element and the mating plug element to establish an electrical connection; and wherein at least one of the plug element and the mating plug element moves within a clearance with respect to its mount during the plugging together of the plug element and the mating plug element to establish the electrical connection.

12. The method according to claim 11, wherein during the act of plugging together the plug element and the mating plug element, said at least one of the plug elements moves in a plugging direction within the clearance with respect to its mount.

13. The method according to claim 12, wherein the other of the plug elements does not move with respect to its mount during the plugging together to establish the electrical connection.

14. The method according to claim 11, further comprising the act of guiding the plug element and the mating plug element against one another via a guide device during the plugging together, said guide device being configured as respective slide face surfaces.

15. The method according to claim 11, further comprising the acts of:

mounting one of the plug element and the mating plug element on a line carrier secured to a first housing lower part before plugging together to form the electrical connection; and mounting the other of the plug elements on a printed circuit board secured to a second housing part before the plugging together to form the electrical connection.

* * * * *